US005168685A

United States Patent [19]

Suzuki

[11] Patent Number: 5,168,685

[45] Date of Patent: Dec. 8, 1992

[54] METHOD AND APPARATUS FOR PACKING AMASSED GOODS WITH AIRING

[75] Inventor: Ken'ichi Suzuki, Kashiwa, Japan

[73] Assignee: Tsukasa Kasei Kogyo Kabushiki Kaisha, Tokyo, Japan

[21] Appl. No.: 762,731

[22] Filed: Sep. 17, 1991

Related U.S. Application Data

[63] Continuation of Ser. No. 621,997, Dec. 4, 1990, abandoned.

[30] Foreign Application Priority Data

Jun. 25, 1990 [JP] Japan ..... 2-166430

[51] Int. Cl.[5] ..... B65B 11/04

[52] U.S. Cl. ..... 53/141; 53/556; 53/587; 53/389.3

[58] Field of Search ..... 53/399, 441, 140, 556, 53/587, 389.3, 141, 588

[56] References Cited

U.S. PATENT DOCUMENTS

| | | | |
|---|---|---|---|
| 4,235,062 | 11/1980 | Lancaster | 53/556 X |
| 4,369,614 | 1/1983 | Tetzner | 53/588 X |
| 4,671,043 | 6/1987 | Forni | 53/556 X |
| 4,754,594 | 7/1988 | Lancaster | 53/399 |
| 4,807,427 | 2/1989 | Casteel | 53/441 X |
| 4,905,451 | 3/1990 | Jaconelli et al. | 53/587 X |

FOREIGN PATENT DOCUMENTS

| | | | |
|---|---|---|---|
| 2810124 | 9/1978 | Fed. Rep. of Germany | 53/588 |

*Primary Examiner*—John Sipos

*Attorney, Agent, or Firm*—Emmanuel J. Lobato; Robert E. Burns

[57] ABSTRACT

In regard to the case when a stretch film is wound round in a state of tension on amassed goods for packing the same, this invention is so designed that the film is split in the width direction and in parallel into a large number of narrow-width tapes, while it is stretched, in a process of winding the film around the goods and thereby diagonal spaces are formed naturally on a desired circumference of the amassed goods, so as to produce an airing effect on the amassed goods.

6 Claims, 5 Drawing Sheets

METHOD AND APPARATUS FOR PACKING AMASSED GOODS WITH AIRING

This is a continuation of application Ser. No. 07/621,997, filed Dec. 4, 1990 now abandoned.

DETAILED DESCRIPTION OF THE INVENTION:

2. Technical Field

In regard to the case when amassed goods are packed in one package by using a stretch-wrap film, this invention relates to a method and an apparatus for packing the goods so that they are kept aired.

2. Prior Art

Stretch-wrap film packing has been conducted for preventing the breakup of goods amassed by stacking a number of box bodies in a certain shape. Conventional methods therefor, however, are not suitable for packing fruits and the like which necessitate airing, since these goods are sealed up by the film owing to the adhesion of the film itself, and therefore net packing has been adopted for packing with airing.

However, a net is much more expensive than the stretch-wrap film and, in addition, it needs to be fixed at the starting end and the terminal by an adhesive tape or the like in the case of pallet packing. Consequently the packing operation requires extra labor and time.

The present invention furnishes a method and an apparatus for packing which enable maintenance of the same airing effect as the net packing, with the stretch-wrap film employed, and it dispenses with an operation of fixing the opposite end parts of the film by making use of the adhesion of the surface of the film, and also attains the airing effect by forming a mesh-like airing part of a split film tape on the whole of amassed goods.

SUMMARY OF THE INVENTION

The stretch-wrap film of the present invention is so designed that a film tape split in a prescribed width beforehand or a plurality of film tapes split in prescribed widths in the course of supply are wound round forward and backward on a pallet-amassed goods on a rotary table obliquely in the shape of a puttee (biasly) from the upper or lower end of the goods, while they are stretched in parallel simultaneously at a desired multiplication rate, so that diagonal or mesh-like space parts be formed. The treatment of the starting end and the terminal of this film can be conducted in the same way as in usual stretch film packing.

Although a means for forming the split film tapes can be adopted arbitrarily in the present invention, a slitter using juxtaposed knife edges is convenient for the purpose.

By controlling the operation of the slitter, it turns possible to seal up only the surface of the upper part of the goods by the stretch film, for instance, and thereby to prevent the infiltration of raindrops.

By forming a fold-back part positively at the opposite edges of each split film tape so as to attain a strongly stretched and wound state, moreover, the area of an airing part is enlarged and also a mechanically stout packing form is obtained.

A folded-part forming means for this purpose can be attained effectively by a relatively simple means such as a wedge or a rod by utilizing that the film is in a stretched state as a whole.

EMBODIMENT

Numeral 1 denotes a rotary table, 2 amassed goods and 3 a feed roll of a stretch-wrap film, and the film having a width of about 500 to 1000 mm is employed.

4 and 5 denote guide rolls and 6 a slitter having knife edges disposed at equal intervals in the direction of the width of the film, and the slitter is provided rotatably on an axis 7 so that it can be touched with or detached from the film, and is equipped with a rotational angle control device not shown in the figures.

8 denotes a brake roll, which can stretch the film by about 500% ordinarily in accordance with the number of rotations of the rotary table. 8*a* denotes a case wherein driving and rotation speed control devices are incorporated.

9 denotes a rotary arm, 9*a* a pivotally fitting element, 10 a pressure roll, and 11 a guide roll.

12 denotes a support frame and 12*a* an extension frame, which are elevated along a mast 13 by a driving device not shown in the figure. 13*a* denotes a slide guide means.

Figure 7:
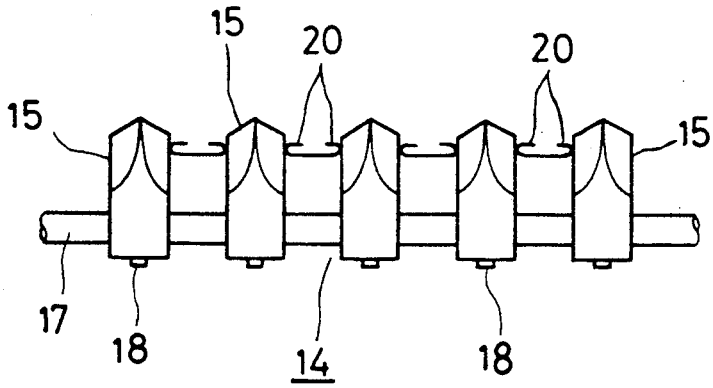
FIG. 7 is a front view of the folded-part forming means of FIG. 5.
Figure 8:
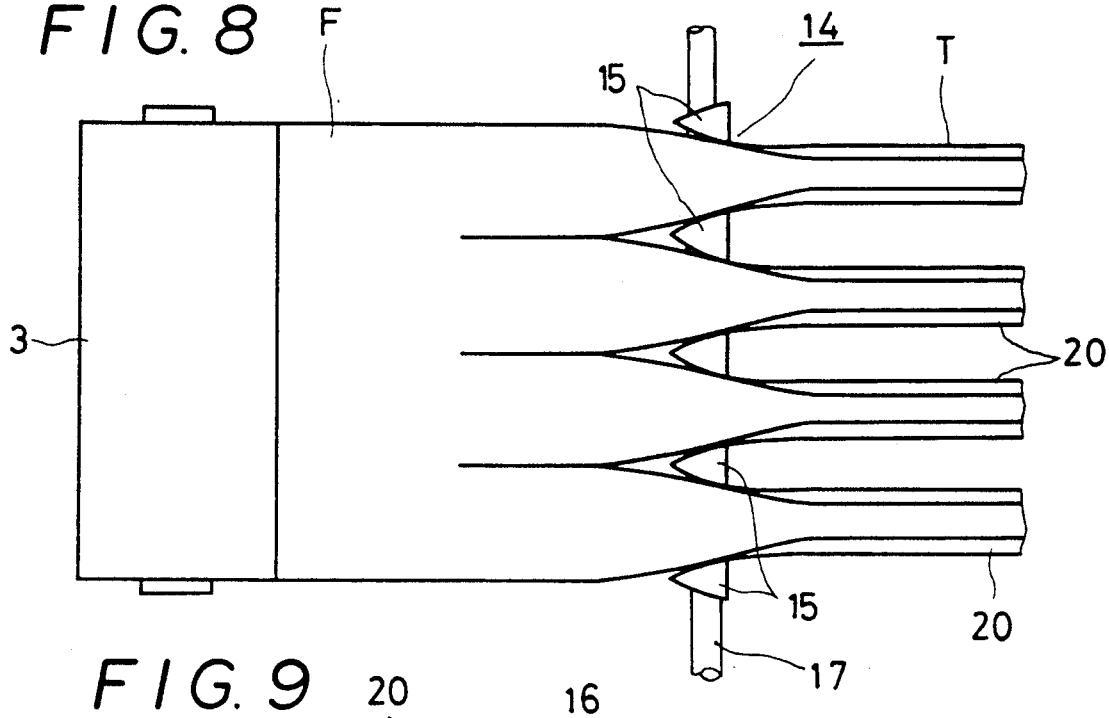
FIG. 8 . is a plan view showing a process of formation of narrow-width tapes.
Figure 9:
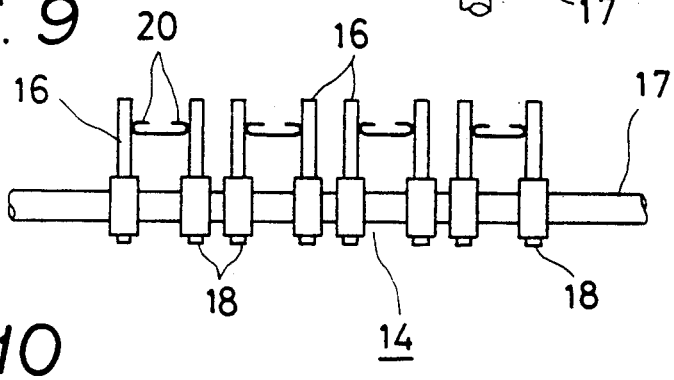
FIG. 9 is a front view of the folded-part forming means of FIG. 6.
Figure 10:
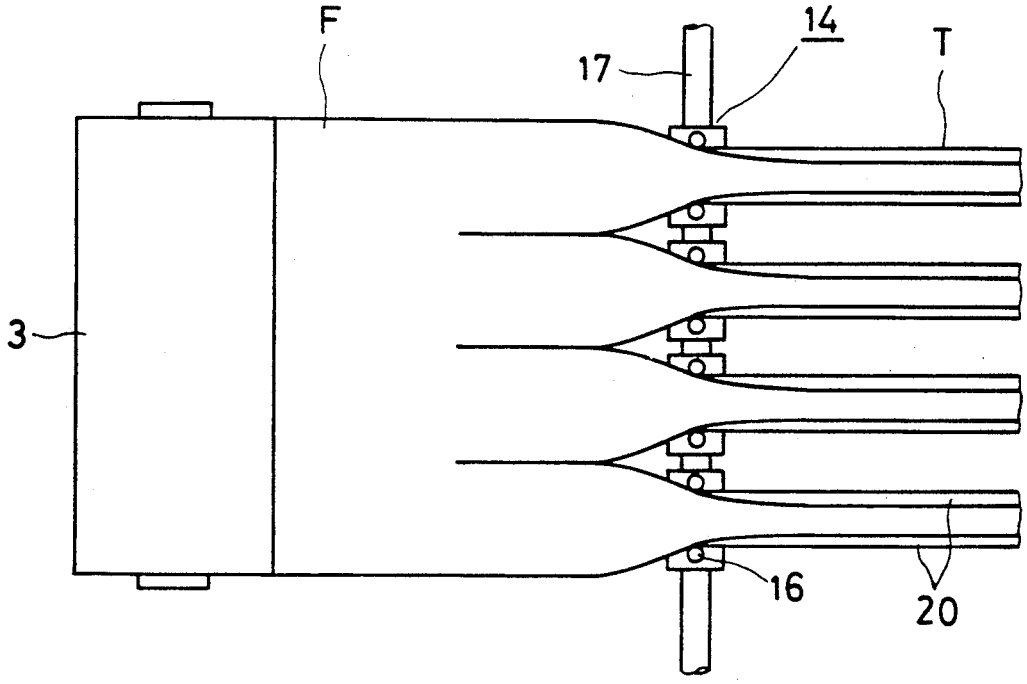
FIG. 10 is a plan view showing a process of formation of narrow-width tapes. Slitters are omitted in FIGS. 3, 8 and 10.

14 denotes a folded-part forming means provided between the slitter 6 and the brake roll 8, and it is equipped with wedge-shaped guiding bodies 15 or rods 16 as shown in FIG. 7 or 9, which are provided with adjusting bolts 18 so that they can be adjusted thereby in axial positions along a shaft 17.

It is advisable that the folded-part forming means is so provided that it can be touched with or detached from the split film in the same way as the slitter 6. 19 denotes a rotating means.

Figure 1:
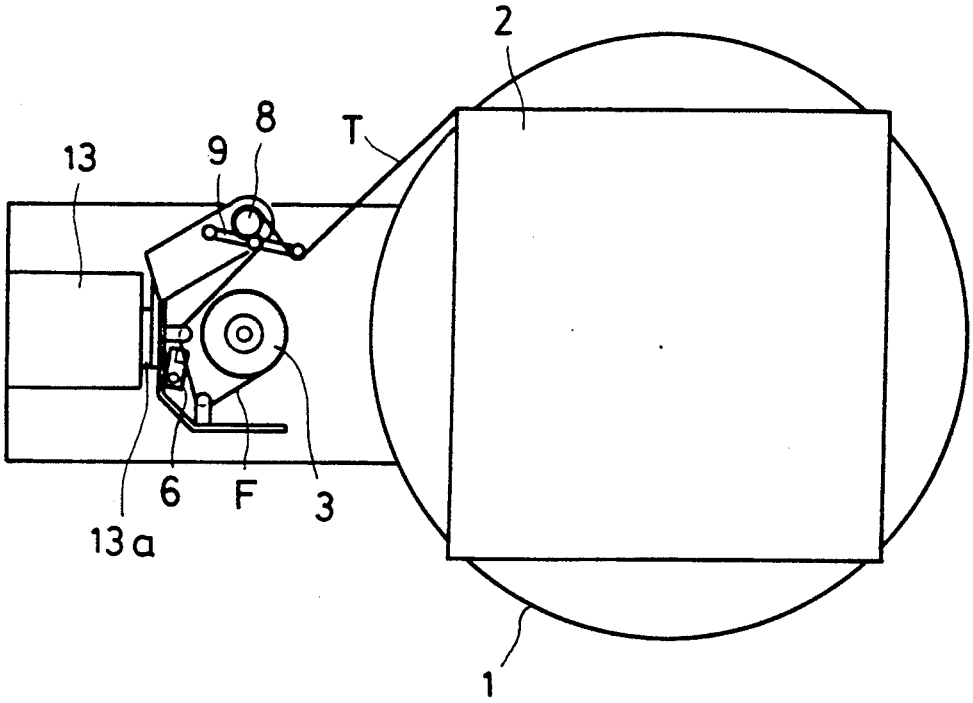
FIG. 1 is an entire plan view of an apparatus of the present invention.
Figure 2:
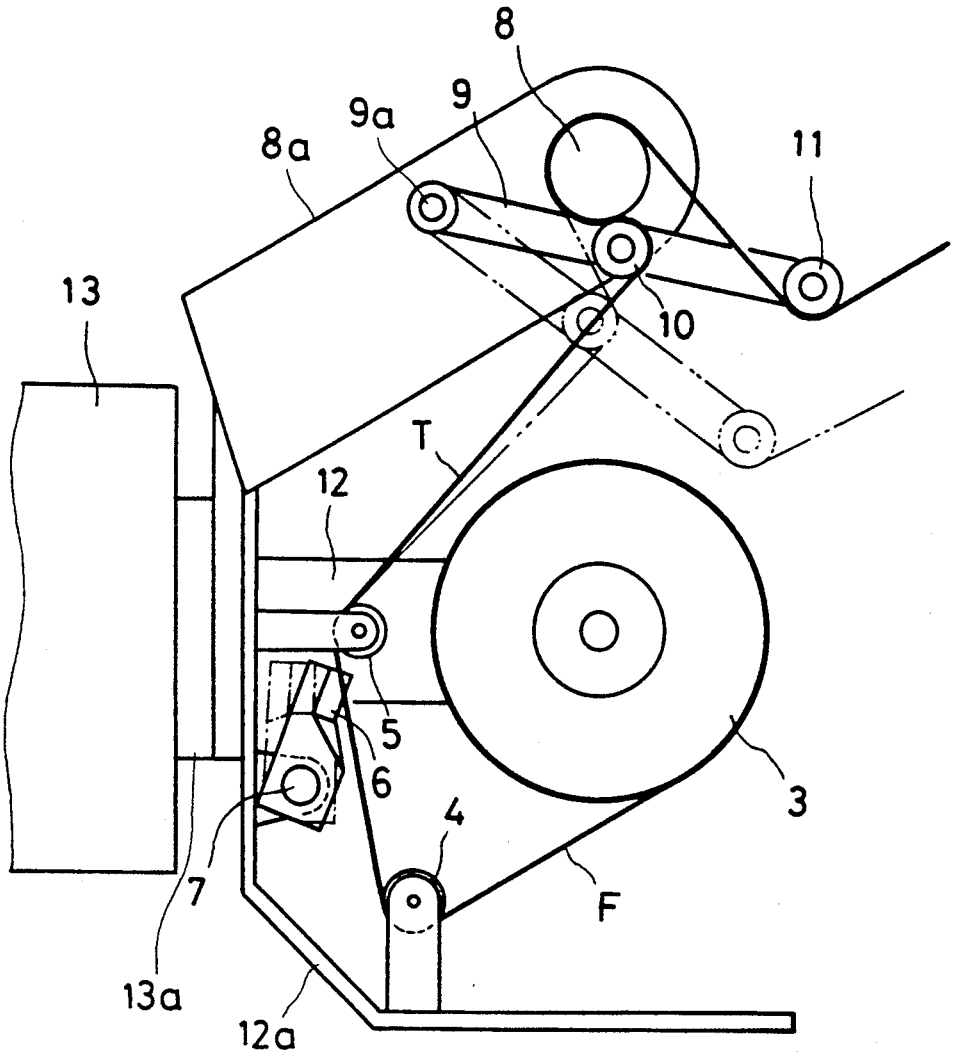
FIG. 2 is a plan view of the principal part thereof.
Figure 3:
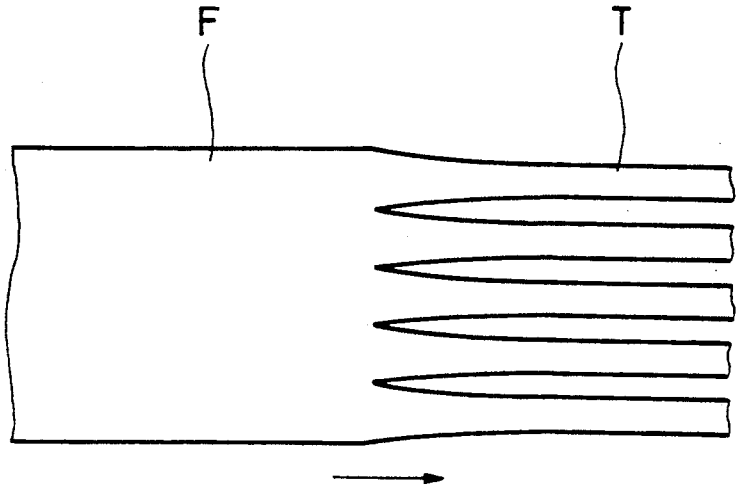
FIG. 3 is a surface view of the state of split tapes.

A stretch-wrap film F from the feed roll 3 is split into five tapes T as shown in FIG. 3, for instance, by the slitter 6 and is stretched in parallel in accordance with the ratio in rotation between the brake roll 8 and the rotary table. Therefore, the respective width of the tapes is made small according to the multiplication rate of stretch and the tapes are wound round biasly in said tape widths on amassed goods.

When a fold-back part 20 is formed in each tape, the narrow-width tape passing through the folded-part forming means 13 is stretched by a stronger force and wound round on the amassed goods 2 strongly.

In this case, in other words, the edges of the tape is folded back to be double, and therefore a tear hardly occurs in the edges even when the strong force of stretch is applied thereto.

In either of the above-described cases, winding can be started from either upper or lower end arbitrarily. When the winding is started at the pallet side, for instance, the film roll is raised gradually, and when it reaches the upper end, the slitter 6 and the folded-part forming means 14 are detached so that the film is wound as an ordinary stretch-wrap film. At the time of lowering, the slitter alone or both the slitter and the folded-part forming means are made to operate again, so that the film is wound biasly in the shape of tapes.

Figure 4:
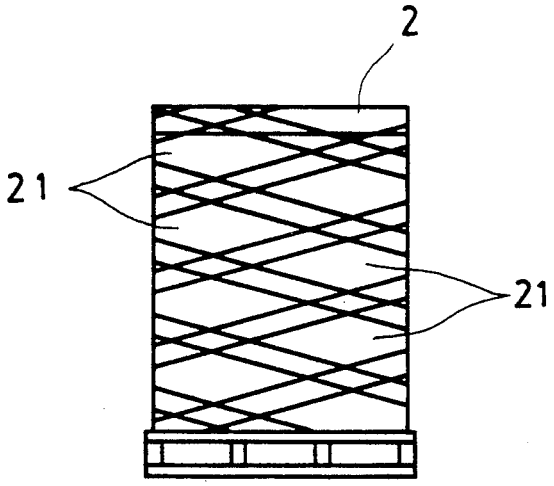
FIG. 4 is a front view of a state of packing.
Figure 5:
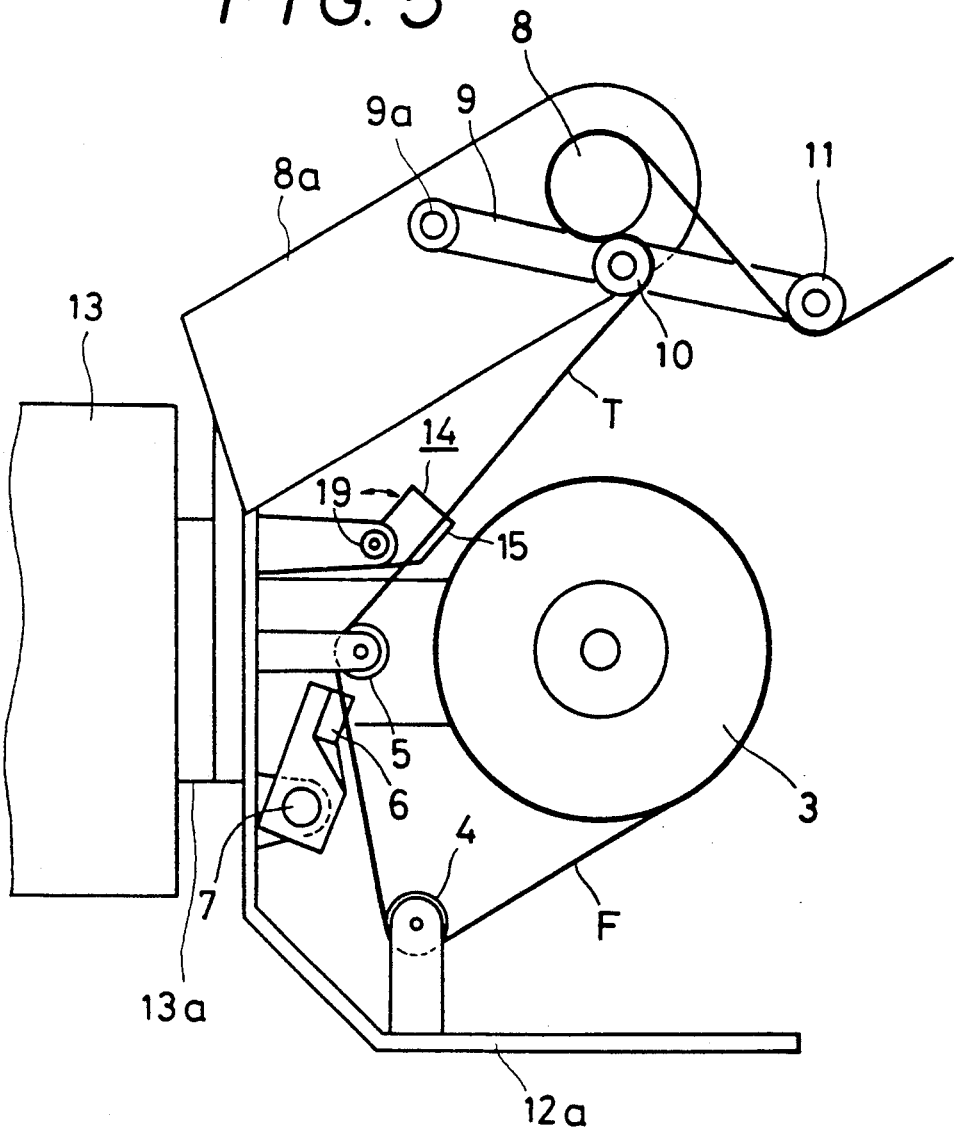
FIGS. 5 and 6 are plan views of the principal parts of the apparatus of the present invention which are provided with folded-part forming means.
Figure 6:
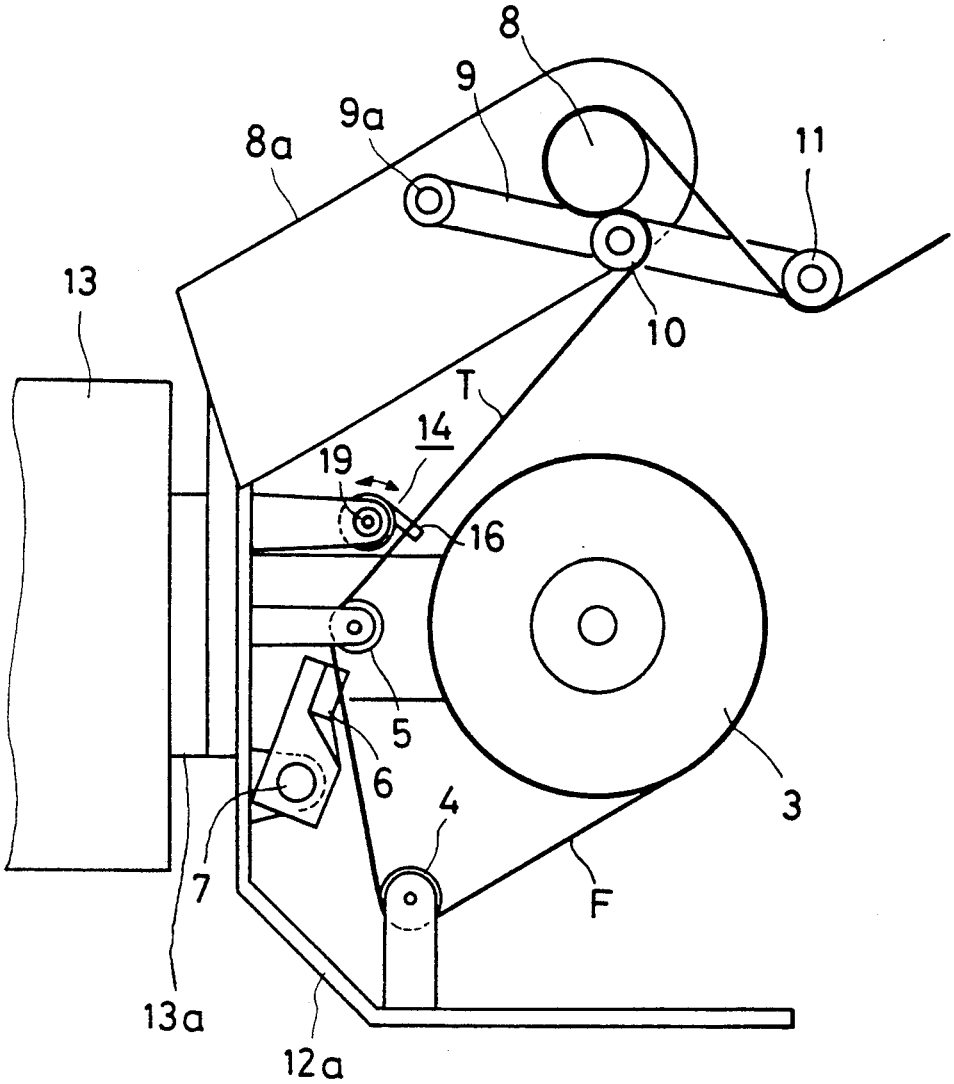

Thereby diagonal airing parts 21 are formed on the lateral side of the intermediate part of the goods (FIG. 4).

On the lower end side, each of the terminals of the tapes may be fitted in a sticking manner by utilizing the self-adhesion of the film, or it is also possible to wind the film round with the slitter set in non-operation.

EFFECT

In the present invention, the width of the tape to be wound can be adjusted arbitrarily by changing the multiplication rate of stretch and the number of the knife edges or the amount of fold at the opposite edges, and thereby the dimensions of the airing parts can be varied.

Moreover, the density of the distribution of the airing parts can be changed according to the number of layers of the wound tapes.

Besides, the upper part and/or the lower part of the goods can be sealed up as occasion calls for, and therefore a preferable packing form can be furnished appropriately in accordance with the properties of goods to be packed.

When it is necessary that the upper surface of the amassed goods, to which the present invention is applied be sealed (for the purpose of preventing raindrops from entering the same goods), the upper surface is enclosed with a cover sheet (not shown) in advance and is wound firmly with a wide wrapper film as the wide wrapper film is stretched with the intermediate portion thereof positioned at the shoulder portions of the amassed goods.

Since the wide wrapper films is wound in a stretched state, the upper half portion of the film is superposed in a folded state on the upper surface of the cover sheet. At the same time, the film is strongly press-bonded at the lower end portions of the cover sheet, i.e. the side surface portions of the amassed goods.

In the packaging method according to the present invention, a wide wrapper film identical with that in a conventional packaging method is used on the upper and lower portions of amassed goods, and the intermediate side surface portions only of the amassed goods are wrapped with slit strip films.

The strip films used in the present invention are folded back at their opposite edge portions as shown in FIGS. 7–10, whereby the stretching strength of the strip films is improved.

The size of the non-film-wound surface portions of the amassed goods can be regulated by increasing or decreasing the width of the folded back portions of the strip films and a draw ratio of the same films.

The present invention needs only a slight alteration of existing equipment and, in addition, the method of operation according thereto is similar to that of conventional stretch-wrap film packing. Therefore it enables execution of economical packing with airing, in addition to excellent operability and the low cost of the film.

I claim:

1. Wrapping apparatus for forming and applying a stretchable self-adhering plastic film mesh wrapping about amassed goods or stacked containers and capable of allowing airing of the goods or contents of the stack containers and forming a unitary package comprising, a rotatably driven table on which amassed goods or containers are held during wrapping thereof, roll-mounting means movable upwardly and downwardly and rotatably mounting a roll of stretchable plastic film having an adhesive agent on one side thereof and a longitudinal axis disposed substantially vertically for movement upwardly and downwardly relative to said table and goods or containers disposed thereon, said roll mounting means for mounting said roll rotatably for unwinding of film from said roll as a film wrapping is applied to said goods or containers on the rotary table when said table is rotatably driven, slitter means movable upwardly and downwardly synchronously with upward and downward movement of said roll and disposed for slitting the film to form a plurality of parallel tapes as the film is unwound from said roll, tension applying means for stretching said parallel tapes jointly as they are being applied to said goods or containers during rotation thereof, means for controlling the rate of upward and downward movement of said roll, the slitter and the tension-applying means for developing a mesh wrapping wound as two oppositely wound spirals spaced parallel tapes, and folding means for automatically reversely folding at least one longitudinal marginal edge portion of each tape over the remainder of said each said tape after slitting of the film and during forming and applying of said mesh wrapping.

2. Wrapping apparatus for forming and applying a stretchable self-adhering plastic film mesh wrapping about amassed goods or stacked container and capable of allowing airing of the amassed goods or contents of the containers and forming a unitary package according to claim 1, in which said slitter comprises a plurality of blades disposed for slitting said film into a plurality of parallel tapes, and said slitter means having said folding means disposed downstream thereof.

3. Wrapping apparatus for forming and applying a self-stretchable self-adhering plastic film mesh wrapping about amassed goods or stacked containers and capable of allowing airing of the amassed goods or contents of the containers and forming a unitary package according to claim 2, in which said slitter comprises a rockable pivot mounting said blades for effecting movement of the blades into an operative position for slitting said film as it is unwound and for moving away from the film as it is unwound to keep from slitting the film.

4. Wrapping apparatus for forming and applying a stretchable self-adhering plastic film mesh wrapping about amassed goods or stacked containers and capable of allowing airing of the amassed goods or contents of the containers and forming a unitary package according to claim 3, in which said blades are mountable individually on said pivot to provide for varying the number of blades on the slitter to thereby vary the number of tapes into which is film is slit and vary the width of the individual tapes.

5. Wrapping apparatus for forming and applying a stretchable self-adhering plastic film mesh wrapping about amassed goods or stacked containers and capable of allowing airing of the amassed goods or contents of the containers and forming a unitary package according to claim 1, in which said folding means for automatically reversely folding each tape longitudinally to strengthen the tapes individually, and the individual folded tapes having said folding effected and retaining a self-adhering characteristic thereof.

6. Wrapping apparatus for forming and applying a stretchable self-adhering film mesh wrapping about amassed goods or stacked containers and capable of allowing airing of the amassed goods or contents of the containers and forming a unitary package according to claim 5, in which said folding means comprises means for variably varying the reverse folding of said tapes for variably determining a width of the individual folded tapes to thereby vary the stretchability and strength thereof.

* * * * *